US005080964A

United States Patent [19]

Tesch

[11] Patent Number: 5,080,964

[45] Date of Patent: Jan. 14, 1992

[54] AGGREGATE OF SPHERICAL FIBERS, PARTICULARLY AS FILLING MATERIAL FOR BLANKETS, SUCH AS QUILTS, PILLOWS AND THE LIKE

[76] Inventor: Günter Tesch, Avenue Jean-Marie-Musy 15, Fribourg, Switzerland, CH-1700

[21] Appl. No.: 415,288

[22] PCT Filed: Oct. 26, 1988

[86] PCT No.: PCT/EP88/00966

§ 371 Date: Oct. 31, 1989

§ 102(e) Date: Oct. 31, 1989

[87] PCT Pub. No.: WO89/06714

PCT Pub. Date: Jul. 27, 1989

[30] Foreign Application Priority Data

Jan. 12, 1988 [CH] Switzerland ..... 00082/88

[51] Int. Cl.[5] ..... D04H 1/58

[52] U.S. Cl. ..... 428/288; 428/212; 428/217; 428/224; 428/297

[58] Field of Search ..... 428/288, 224, 212, 217, 428/297

[56] References Cited

U.S. PATENT DOCUMENTS

| | | | |
|---|---|---|---|
| 4,413,030 | 11/1983 | Tesch et al. | 428/85 |
| 4,481,247 | 11/1984 | Tesch et al. | 428/234 |
| 4,588,635 | 5/1986 | Donovan | 428/288 |
| 4,618,531 | 10/1986 | Marcus | 428/223 |
| 4,814,229 | 3/1989 | Tesch | 428/402 |

FOREIGN PATENT DOCUMENTS

| | | |
|---|---|---|
| 0013427 | 7/1980 | European Pat. Off. . |
| 0203469 | 12/1986 | European Pat. Off. . |
| 0257658 | 3/1988 | European Pat. Off. . |
| 2148706 | 6/1985 | United Kingdom . |

*Primary Examiner*—James J. Bell
*Attorney, Agent, or Firm*—Bacon & Thomas

[57] ABSTRACT

An aggregate of spherical fibers, particularly for use as filling material for blankets, such as quilts, pillows or the like comprises fibers and/or threads that are wrapped spherically and essentially form a fibrous ball. So that the properties of the aggregate of spherical fibers are better, particularly for use as filling material in blankets, such as quilts, pillows or the like, it is proposed that the fibrous balls contain a mixture of fibers, whereby one type of fiber has a higher modulus of elasticity compared to another type of fiber. The fibers with the higher modulus of elasticity can also taper over their length.

6 Claims, No Drawings

AGGREGATE OF SPHERICAL FIBERS, PARTICULARLY AS FILLING MATERIAL FOR BLANKETS, SUCH AS QUILTS, PILLOWS AND THE LIKE

The invention relates to an aggregate of spherical fibres, particularly as filling material for blankets, such as quilts, pillows or the like, which aggregate comprises fibres and/or threads that are wrapped spherically and essentially form a fibrous ball.

Blankets, particularly quilts, should protect the human body. They create a zone between the body and the surrounding air which impedes an exchange of heat between the body and the surroundings and thereby reduces the radiation of heat from the human body, thereby preventing an undercooling of the resting body.

The retention of heat by means of a blanket, such as a quilt or the like, is essentially achieved by providing an immovable air volume above the human body, i.e. the effect is for the most part achieved by a stationary air cushion, whereby use is made of the fact that air has a low coefficient of thermal conduction. The larger this air volume is, the greater the heat retentivity of the blanket. As a rule, however, this larger air volume can only be achieved with a heavier blanket.

Expensive blankets are therefore filled with down which is relatively light but can provide a large volume because of its bulkiness. Down, however, is very expensive and is also not available in unlimited quantities.

It has already been proposed to fill quilts with a non-woven fleece. The fibrous materials used therefor are not able, however, to provide an adequate volume with an acceptable mass per unit area.

According to a recent not pre-published proposal, cushions, in particular pillows, are filled with aggregates of spherical fibres comprising fibres and/or threads that are wrapped spherically and essentially form a fibrous ball.

The aggregates of fibres used therefor are basically known from EP-A-0 013 427, wherein fibres are described which are wrapped into fibre balls. These fibrous balls have a diameter of at least 3 mm. The balls can also have a diameter up to 50 mm. The fibres used therein have a length of at least 15 mm, preferably between 40 and 120 mm. The density of the fibrous balls lies between 0.01 and 0.1 g/cm$^3$. The fibres of these fibrous balls can be natural fibres, for example cotton or wool fibres, animal hair and the like, or synthetic fibres, for example polyamide, polyester, polypropylene fibres and the like, or a mixture of these. In particular, these fibrous balls can contain crimped fibres such as, for example, crimped synthetic fibres. Such fibrous balls have so far been used essentially for textile fabrics, in particular for carpet manufacture, for clothing material, blankets, decorative fabrics or textile upholstery material. As described in EP-A-0 013 427, these fibrous balls are suitable as filling material if they contain binding agents which ensure that the individual balls do not break up and divide into their individual fibres.

The fibrous balls used in the cushions, particularly pillows, are to support the head of the user. Since the sleeper's head lies on the pillow, the total weight of the pillow is less relevant than that of a blanket which lies on the sleeper.

It is the object of the invention to provide aggregates of fibres which have better properties, especially for use as filling material in blankets, such as quilts, pillows or the like.

This object is accomplished by the invention. The fibrous balls according to the invention contain a mixture of fibres, whereby one type of fibre has a low modulus of elasticity while another type of fibre has, in comparison, a much higher modulus of elasticity.

The two types of fibres also differ particularly in that the fibres with the low modulus of elasticity can be formed into balls very easily whereas the fibres with the much higher modulus of elasticity can be formed into balls, if at all, only with difficulty, since they have a very high inner resiliency.

A fibrous ball made from such a mixture of fibres surprisingly has a very large volume and is thus bulkier than the known fibrous balls. Thus, the density of such a fibrous ball is substantially lower than that of the known fibrous balls, whereby the fibrous balls have a very high air volume with a relatively low weight. Therefore, such fibrous balls are particularly suitable for blankets, such as quilts or the like, which by means of a large stationary inner air cushion allow as little heat as possible to pass through, but on the other hand should not be too heavy.

Preferably, fibres which taper over their length are used as fibres with the higher modulus of elasticity. Thus, the diameter at the respective ends of these fibres differs. The elasticity in these fibres thereby differs over the length of these fibres. This can have a positive effect when processing the fibres.

According to one embodiment, the fibres with the lower modulus of elasticity are crimped, whereas the fibres with the high modulus of elasticity are for the most part uncrimped.

The fibres with the higher modulus of elasticity are preferably coarser and/or stiffer than the fibres with the lower modulus of elasticity.

The fibres used for these fibrous balls can be natural fibres, for example cotton or wool fibres, animal hair and the like, or synthetic fibres, for example polyamide, polyester, polypropylene fibres and the like, having the respective properties according to the invention.

According to a preferred embodiment, both the fibres with the higher modulus of elasticity and the fibres with the lower modulus of elasticity are natural fibres. Use of natural fibres in the blankets not only makes them more valuable, they also promote sleeping comfort.

The fibrous balls can be manufacture according to the method described in EP-A-0 013 427.

What is claimed is:

1. An aggregate of spherical fibres, particularly as filling material for blankets, such as quilts, pillows or the like, comprising fibres and/or threads that are wrapped spherically and essentially form a fibrous ball, wherein the fibrous balls contain a mixture of fibres, wherein one type of fibre has a higher modulus of elasticity in comparison to another type of fibre and wherein the fibres with the higher modulus of elasticity taper over their length.

2. An aggregate of spherical fibres according to claim 1 wherein the fibres with the higher modulus of elasticity are essentially uncrimped.

3. An aggregate of spherical fibres according to claim 1 wherein the fibres with the lower modulus of elasticity are crimped.

4. An aggregate of spherical fibres according to claim 1 wherein the fibres with the lower modulus of elasticity are spiral-crimped.

5. An aggregate of spherical fibres according to claim 1 wherein the fibres with the higher modulus of elasticity are coarser and/or stiffer than the fibres with the lower modulus of elasticity.

6. An aggregate of spherical fibres according to claim 1 wherein both the fibres with the higher modulus of elasticity and the fibres with the lower modulus of elasticity are natural fibres.

* * * * *